US005572225A

United States Patent [19]

McCarthy

[11] Patent Number: 5,572,225

[45] Date of Patent: Nov. 5, 1996

[54] ANTENNA MOUNTING DEVICE

[76] Inventor: John McCarthy, 16912 Westwood La. #31, Huntington Beach, Calif. 92647

[21] Appl. No.: 515,145

[22] Filed: Aug. 15, 1995

[51] Int. Cl.[6] ..... H01Q 1/00; G09F 17/00

[52] U.S. Cl. ..... 343/720; 343/715; 40/519; 116/28 R; 116/173; 403/300

[58] Field of Search ..... 343/711, 712, 343/713, 714, 715, 720, 906; 116/28 R, 209, 173; 40/218, 519, 643; 403/300; 428/31; H01Q 1/00

[56] References Cited

U.S. PATENT DOCUMENTS

| | | | |
|---|---|---|---|
| 2,329,046 | 9/1943 | Halbig | 41/10 |
| 3,172,220 | 3/1965 | Christensen | 40/39 |
| 3,531,634 | 9/1970 | Plouch | 116/28 R |
| 3,929,310 | 12/1975 | Peham | 248/226 E |
| 4,039,894 | 8/1977 | Gardner, III | 343/721 |
| 4,978,964 | 12/1990 | Castille | 343/715 |
| 4,989,536 | 2/1991 | Liming et al. | 116/173 |
| 5,078,075 | 1/1992 | Liming et al. | 116/173 |
| 5,415,491 | 5/1995 | Hayakawa et al. | 403/300 |

*Primary Examiner*—Donald T. Hajec
*Assistant Examiner*—Tan Ho
*Attorney, Agent, or Firm*—Gene Scott Patent Law & Venture

[57] ABSTRACT

A connector device for interconnecting an antenna with a novelty toy or display item, the connector device having a disk-shaped base with a radial slot that extends from an outer base portion edge to the approximate center of the base portion, and two or more spaced-apart prongs extending upwardly from the base portion. The slot is wide enough to accept the vehicle antenna, thus allowing the antenna to be slidingly engaged within the base portion. The prongs have an inwardly angled upper portion which terminates with a sharp tip so as to easily insert the prongs into the material of the novelty at the bottom of a hole therein. The upper portion also provides a horizontal downfacing lip that prevents the novelty from being easily removed from the device and a horizontal upfacing lip that prevents the prongs from being inserted too far into the novelty. A crushable material plug is used to assure a tight fit between the antenna and the novelty.

10 Claims, 2 Drawing Sheets

ANTENNA MOUNTING DEVICE

BACKGROUND OF THE INVENTION

1. Field of the Invention:

This invention relates generally to devices for mounting objects to an antenna, and more particularly to an improved device that is lightweight, inexpensive to manufacture and provides for a stable interconnection between an automobile antenna and a soft plastic novelty.

2. Description of Related Art:

Invention and use of antenna mounting devices are known to the public, as they have been used to mount a wide variety of different objects to an automobile antenna. For example, Halbig U.S. Pat. No. 2,329,046 discloses an ornamental display for attaching to the tip end of an automobile antenna. However, as disclosed, this device is designed to be engaged over the end of an antenna in which the enlarged tip portion of the antenna has been broken off or removed. Even further, this device is limited in that the mounting means is integral with the ornamental display, thus requiring that an entire new device be purchased each time it is desired to change the ornamental display.

Christensen U.S. Pat. No. 3,172,220 teaches a device for attaching a display to the end of a rod, such as an antenna. The device includes an outer shell and an insert which fits within the outer shell to wedge the assembly into an integral unit. A small slit is provided in the outer shell, the slit being of a size appropriate for accepting a generally planar display, such as a sign. However, while this configuration may effectively be used to mount a planar display to the end of a rod, it is unable to accommodate the mounting of objects having a variety of different sizes and shapes.

Liming et al. U.S. Pat. No. 4,989,536 teaches an antenna mounting device having two halves which join laterally around the antenna. The device has an antenna clamp with complementary halves configured to fit onto the mast and tip of a vehicle antenna to hold the cord of a banner-like object. A cap-like structure is pressed over the assembly to hold it in place and the cap itself is held frictionally by securing elements. Liming et al. U.S. Pat. No. 5,078,075 discloses a similar device having a hinged inner part configured to fit around both mast and the tip at the top of the mast and secure a connective member of an object to the mast. The device also has several engaging means to mechanically hold the enclosing unit on the mast and tip. However, while both of these devices may be used to effectively secure a novelty item to an antenna, they are relatively complex devices having moving parts and are therefore relatively expensive to manufacture.

Thus, there is a clear need for an improved antenna mounting device that is capable of mounting a wide variety of different items to the end of an automobile antenna. Such a device would be very simple both to manufacture and to apply to an antenna, and it would also be very inexpensive to manufacture. The present invention fulfills these needs and provides further related advantages as described in the following summary.

SUMMARY OF THE INVENTION

The present invention is an improved antenna mounting device designed to enable a novelty item to be quickly and easily mounted to an end of an antenna of a vehicle or the like. The present invention is designed for use in conjunction with a novelty item having a generally cylindrical cavity containing a soft plastic insert. The novelty item may be considered to be a part of the present invention, or not. In any case, a connector of highly unique detail is used to connect the novelty with the antenna. This connector consists of a small, rigid, horizontally oriented disk with one or more prongs extending upwardly from it. A slot is positioned in the device so as to allow the disk to be inserted onto the antenna, with the termination of the antenna, usually a small ball, acting to retain the connector onto the antenna. Thus it is an object of the present invention to provide a connector that is able to hold a novelty onto the end of an antenna.

It is another object of the present invention to provide a connector which is easy to secure to the novelty item but which is difficult to be inadvertently removed or loosened. To facilitate the easy insertion of the device, an upper portion of the prongs are tapered inwardly so as to come to a sharp pointed edge at the terminal end, the edge easily penetrating the material of the novelty. The device is constructed of a relatively rigid, yet slightly flexible material as to allow the prongs of the device to flex inwardly upon insertion into the cavity. This configuration ensures that the novelty is not easily removed from the antenna, as the prongs are pressed firmly against the cavity wall. In addition, a downfacing ridge, on each prong, is provided at the end of the tapered upper portion, the lip engaging the cavity wall so as to keep the device firmly in place. The present invention is secure even on retractable antennas.

A further objective of the invention is to provide a crushable insert held between the novelty and the connector, which accommodates the insertion of the tip of the antenna so as to lock the novelty in place on the antenna.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a novelty object for mounting onto the end of an automobile antenna, including a connector device for locking the novelty in place. In such drawings.

DETAILED DESCRIPTION OF THE PREFERRED EMBODIMENT

Figure 2:
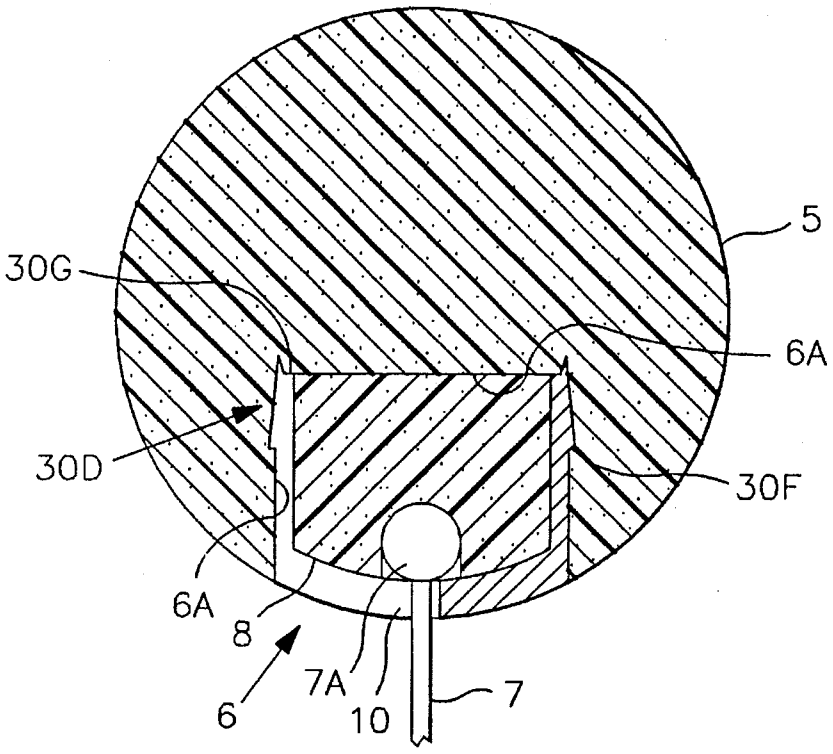
FIG. 2 is a cross-sectional view thereof taken along line 2—2 of FIG. 1.
Figure 1:
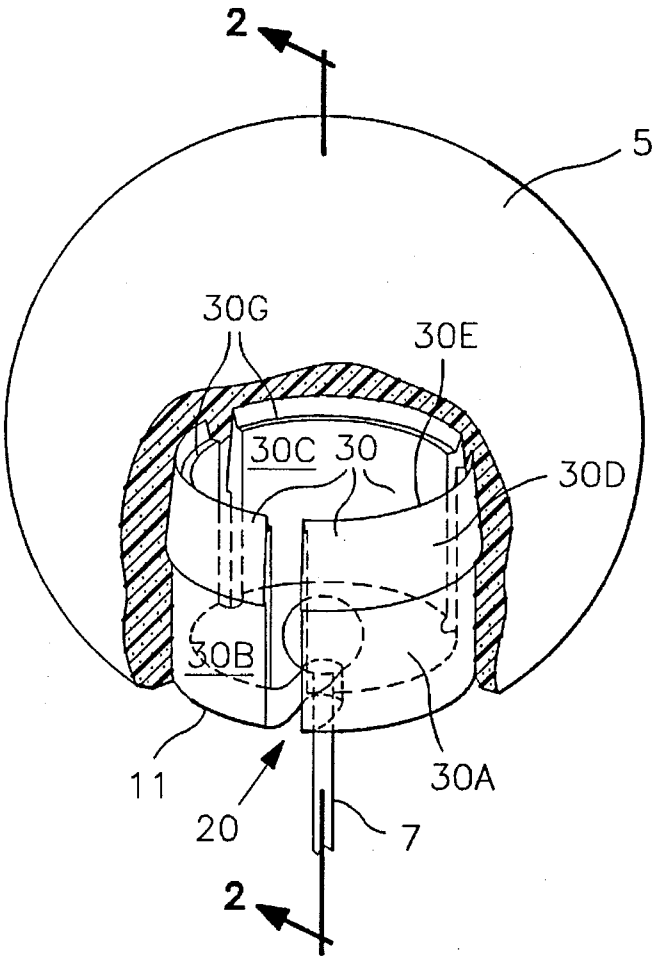
FIG. 1 is a perspective view of the preferred embodiment of the present invention, particularly showing a connector, a novelty toy, and an antenna.
Figure 4:
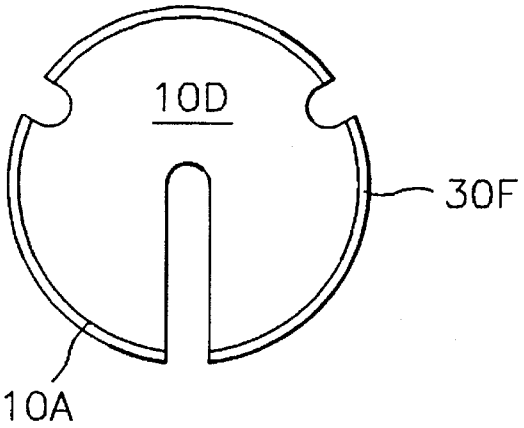
FIG. 4 is a bottom plan view of the connector.
Figure 3:
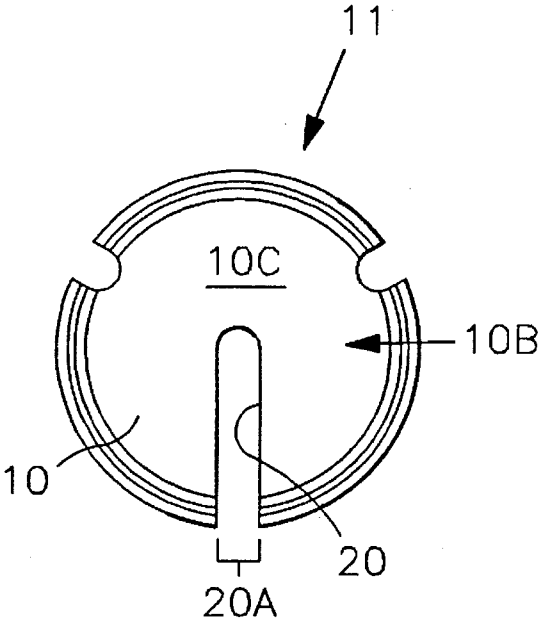
FIG. 3 is a top plan view of the connector.

In the drawings, FIGS. 1 and 2 illustrate a toy or novelty item 5 mounted onto the end of an automobile antenna 7. The novelty item 5 may be a ball or other recognizable shape and it is connected to the antenna by a connector device 11 such that it not easily removed nor loosened. The novelty object has a generally cylindrical cavity or blind hole 6, which is filled by an insert or plug 8 positioned within the cavity 6. Preferably, the novelty 5 is constructed of a relatively soft plastic material, such as expanded polystyrene, while the plug 8 is preferably constructed of a crushable material such as styrofoam. The connector device 11 itself is preferably constructed of a relatively rigid and hard yet resilient structural plastic such as ABS plastic.

The connector device provides a base portion 10, of a horizontally oriented disk, or modified disk shape with a slot 20 extending radially from a peripheral edge 10A of the base portion 10 to a central position 10B of the base portion, the slot 20 has a width 20A for accepting the automobile antenna 7 in sliding engagement so that the antenna 7 may be slid into the center of the base portion 10. At least two prongs 30, integral with the base portion 10 extend vertically upwardly from a face 10C thereof, each of the prongs 30 providing a wall 30A having an outside surface 30B facing away from the central position 10B of the base portion 10, and an inside surface 30C facing toward the central position 10B of the base portion. Each of the prongs 30 further provide an upper end portion 30D having a modified wedge shape terminating with a sharp ridge tip 30E capable of being pressed into the surface of the novelty object 5. The upper end portion 30D overhangs the outside surface 30B forming a horizontal downfacing rim 30F which normally presses itself against the sidewall 6A of the cavity 6 forcing the sidewall 6A to conform to it so that the rim 30F resists withdrawal of the connector device 11 from the novelty object 5. The upper end portion 30D provides a horizontal upfacing rim 30G which acts as a stop preventing the further insertion of the connector device 11 into the novelty object 5. It has been found that the wedge shape is preferably formed at an angle of between 10 and 45 degrees. In this range, the sharp ridge tip 30E is generally able to be pushed into the material of the novelty object 5 by simple hand manipulation. The novelty object 5 may be a round ball with the look of a baseball, a basketball or a volleyball or other round recognizable object, or may be in the shape of a football or other shape. It is desired to have the contour of a bottom, downfacing surface 10D of the disk such as to coincide with the contour of the outer surface of the novelty object. In the case of a spherical novelty object 5, the surface 10D is preferably convex.

Automobile antennas typically terminate with a ball or other device for preventing the tip of the antenna from impaling an individual. It is this termination feature 7A with locks the connector device 11 onto the antenna 7. However, the antenna termination feature 7A may be large or small, depending upon the make of the antenna or the automobile. In order to, at once, accommodate any antenna make, and also to assure that the novelty object 5, does not become loose on the antenna 7, a plug 8 of crushable material is inserted within the connector as best shown in FIG. 2. This plug 8 fits between the prongs 30 of the connector and extends from a bottom surface 6A of the hole to the upfacing face 10C of the disk. Thus, the antenna termination feature 7A is imbedded into the plug 8 providing lateral stability to the assembly.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A connector device for interconnecting an automobile antenna with a novelty object, the device comprising:

a base portion shaped as a horizontally oriented disk and having a slot extending radial from a peripheral edge of the base portion to a central position of the disk base portion, the slot having a width for accepting the automobile antenna in sliding engagement;

at least two prongs integral with the disk and extending vertically upwardly from a face thereof, each of the prongs providing a wall having an outside surface facing away from the central position of the base portion, and an inside surface facing toward the central position of the base portion;

each of the prongs further providing an upper end portion having a wedge shape terminating with a sharp ridge tip pressing into the novelty object, the upper end overhanging the outside surface forming a horizontal downfacing ridge for resisting withdrawal of the device from the novelty object, the upper end providing a horizontal upfacing ridge for retarding the further insertion of the device into the novelty object.

2. The device of claim 1 wherein the wedge shape is formed at an angle of between 10 and 45 degrees.

3. The device of claim 1 wherein a bottom, downfacing surface of the base portion is convex.

4. An automobile antenna ornamental device comprising:

a soft plastic novelty object having an exterior surface with a circular blind hole;

a connector device for interconnecting an automobile antenna with the novelty object, the device comprising:

a base portion shaped as a horizontally oriented disk and having a slot extending radially from a peripheral edge of the base portion to a central position of the base portion, the slot having a width for accepting the automobile antenna in sliding engagement;

at least two prongs integral with the base portion and extending vertically upwardly from a face thereof, each of the prongs providing a wall having an outside surface facing away from the central position of the base portion, and an inside surface facing toward the central position of the base portion, the prongs fitting tightly against a wall of the blind hole and having enough resilience to act in spring-like fashion against such wall for holding the connector device in the hole;

each of the prongs further providing an upper end portion having a wedge shape terminating with a sharp ridge tip of sufficient hardness as to be insertable into the surface of the novelty object, the upper end overhanging the outside surface forming a horizontal downfacing ridge for resisting withdrawal of the device from the novelty object, the upper end providing a horizontal upfacing ridge for retarding the further insertion of the device into the novelty object.

5. The device of claim 4 further including a circular plug of crushable material of a size for fitting within the blind hole, the plug fitting between the prongs of the connector and extending from a bottom surface of the hole to the upfacing face of the base portion, the antenna terminating within the plug.

6. The device of claim 4 wherein the wedge shape is formed at an angle of between 10 and 45 degrees.

7. The device of claim 4 wherein a bottom, downfacing surface of the base portion is convex.

8. A connector device for interconnecting an automobile antenna with a novelty object, the device comprising:

a base portion shaped as a horizontally oriented disk and having a slot extending radially from a peripheral edge of the base portion to a central position of the disk base portion, the slot having a width for accepting the automobile antenna in sliding engagement;

at least one prong integral with the disk and extending vertically upwardly from a face thereof, the at least one prong providing a wall having an outside surface facing away from the central position of the base portion, and an inside surface facing toward the central position of the base portion, the at least one prong having a wedge shape terminating with a sharp ridge tip pressing into the novelty object.

9. The device of claim 8, wherein the at least one prong includes a horizontal downfacing ridge for resisting withdrawal of the device from the novelty object.

10. The device of claim 9, wherein the at least one prong includes a horizontal upfacing ridge for retarding insertion of the device into the novelty object.

* * * * *